United States Patent [19]

Tanifuji et al.

[11] 3,940,960

[45] Mar. 2, 1976

[54] INTERSTAND TENSION CONTROL METHOD AND APPARATUS FOR TANDEM ROLLING MILLS

[75] Inventors: Shinya Tanifuji; Yasuo Morooka; Masaya Tanuma, all of Hitachi, Japan

[73] Assignee: Hitachi, Ltd., Japan

[22] Filed: Jan. 17, 1975

[21] Appl. No.: 541,953

[30] Foreign Application Priority Data

Jan. 21, 1974 Japan ..... 49-8588

[52] U.S. Cl. ..... 72/19

[51] Int. Cl.[2] ..... B21B 37/00

[58] Field of Search ..... 72/6–8, 19

[56] References Cited

UNITED STATES PATENTS

| | | | |
|---|---|---|---|
| 3,332,263 | 7/1967 | Beadle et al. | 72/7 |
| 3,457,747 | 7/1969 | Yeomans | 72/19 |
| 3,807,208 | 4/1974 | Hensleigh | 72/19 |

*Primary Examiner*—Milton S. Mehr

*Attorney, Agent, or Firm*—Craig & Antonelli

[57] ABSTRACT

In a tandem rolling mill consisting of at least a first rolling stand and a second rolling stand, the interstand tension is controlled by the steps of detecting the rolling force $P_{10}$ and rolling torque $G_{10}$ at the first rolling stand after a workpiece is fed into the nip between the rolls of the first rolling stand but before the workpiece is fed into the nip between the rolls of the second rolling stand, storing in a memory the ratio $G_{10}/P_{10}$ representative of the reference torque arm value for the first rolling stand in a tension-free state, detecting the rolling forces $P_{1B}$, $P_{2B}$ and rolling torques $G_{1B}$, $G_{2B}$ at the respective rolling stands immediately after the workpiece is fed into the nip between the rolls of the second rolling stand, computing the reference torque arm value $G_{20}/P_{20}$ for the second rolling stand in a tension-free state on the basis of these detected values, and controlling the rolling speed of the first or second rolling stand so that $(G_{10}/P_{10}) - (G_1/P_1)$ representing the deviation of the torque arm value detected at the first rolling stand in rolling operation from the reference torque arm value $G_{10}/P_{10}$ stored in the memory is equal to $(G_{20}/P_{20}) - (G_2/P_2)$ representing the deviation of the torque arm value detected at the second rolling stand in rolling operation from the reference torque arm value $G_{20}/P_{20}$, whereby the workpiece can be rolled tension-free.

15 Claims, 5 Drawing Figures

INTERSTAND TENSION CONTROL METHOD AND APPARATUS FOR TANDEM ROLLING MILLS

This invention relates to a method and apparatus for controlling the interstand tension imparted to a workpiece being rolled by rolling stands of tandem rolling mills.

In tandem rolling mills, various rolling conditions must be maintained constant throughout the rolling operation in order that a workpiece can be rolled to have a uniform thickness and the same size and shape between the leading and trailing end portions thereof.

The leading and trailing end portions of a workpiece can be usually rolled in a tension-free state in a tandem rolling mill. However, in the portion intermediate between the leading and trailing end portions of the workpiece in the longitudinal direction thereof, the tension (including the compressive force) imparted to such portion being rolled by the rolling stands tends to vary due to an abrupt variation in the thickness of the workpiece. Such interstand tension variation tends to occur also due to the presence of thermal rundown and skid marks in the longitudinal direction of the workpiece when the workpiece is subject to hot rolling. Impartation of such varying tension to the workpiece results not only in an undesirable difference between the thickness, size and shape of the end portions and those of the intermediate portion of the workpiece, but also in undesirable variations in the thickness, size and shape of various parts of the intermediate portion of the workpiece. Especially, when a workpiece is rolled into an angle bar, a round bar, a square bar, a wire or the like, more difficulty is encountered in adjusting the screw-down ratio to compensate for this variation of the interstand tension than when such workpiece is rolled into a strip form, and it is generally necessary to roll the workpiece in a tension-free state or in a state in which a constant tension is imparted thereto.

A known publication, for example, Japanese Patent Publication No. 37904/1973 discloses a method of rolling a workpiece in a tension-free state by a tandem rolling mill consisting of at least a first rolling stand and a second rolling stand. According to this method, the rolling force $P_{10}$ and rolling torque $G_{10}$ at the first rolling stand are detected after the workpiece is fed into the nip between the rolls of the first rolling stand but before the workpiece is fed into the nip between the rolls of the second rolling stand, and the value of the ratio $G_{10}/P_{10}$ between the rolling torque $G_{10}$ and the rolling force $P_{10}$ (this ratio representing the torque arm at the first rolling stand) is stored in a memory as the reference torque arm value for the first rolling stand operating in a tension-free state. Then, the rolling force $P_1$ and rolling torque $G_1$ at the first rolling stand are detected when the workpiece is being rolled by the first and second rolling stands after it is fed into the nip between the rolls of the second rolling stand, and the ratio $G_1/P_1$ between the rolling torque $G_1$ and the rolling force $P_1$ is computed. Thereafter, the speed of the first or second rolling stand is controlled in such a manner that the actually detected torque arm value $G_1/P_1$ is always equal to the reference torque arm value $G_{10}/P_{10}$ so that the workpiece can be rolled in a tension-free state.

In this prior art method, no tension is imparted to the workpiece immediately after it is fed into the nip between the rolls of the first rolling stand and immediately before it is fed into the nip between the rolls of the second rolling stand. Thus, the torque arm value $G_{10}/P_{10}$ obtained on the basis of the rolling force $P_{10}$ and rolling torque $G_{10}$ detected at the first rolling stand in such a tension-free state can be used as the reference torque arm value for the first rolling stand in the tension-free rolling operation after the workpiece is fed into the nip between the rolls of the second rolling stand.

According to this prior art method, however, this reference torque arm value is maintained constant even when a tension appears due to disturbance which provides substantial adverse effects in the course of the rolling operation, such as, abrupt variations of the thickness of the workpiece being rolled, and thermal rundown and skid marks present in the workpiece being rolled. Such disturbance makes impossible to roll the workpiece in the desired tension-free state or in the desired constant tension state.

Further, application of this prior art method to a tandem rolling mill including three or more rolling stands tends to give rise to a problem as pointed out below. When a workpiece is fed progressively into the nip between the rolls of an Nth, an (N+1)th and an (N+2)th rolling stand arranged in tandem, the workpiece may possibly be fed into the nip between the rolls of the (N+2)th rolling stand before the tension imparted to the workpiece portion moving between the Nth rolling stand and the (N+1)th rolling stand can be compensated. In such a case, the reference torque arm value for the (N+2)th rolling stand obtained by computation is no more suitable as the proper reference torque arm value for that rolling stand in the desired tension-free state. Further, after the workpiece is fed into the nip between the rolls of the (N+1)th rolling stand, a tension tends to be imparted by the so-called impact drop effect to the workpiece portion moving between the Nth rolling stand and the (N+1)th rolling stand. The rotating speed of the rolls of the (N+1)th rolling stand may be varied to compensate for this tension, but this may result in impartation of a tension to the workpiece portion moving between the (N+1)th rolling stand and the (N+2)th rolling stand.

It is therefore an object of the present invention to provide, in a tandem rolling mill, a novel and improved interstand tension control method and apparatus which can control the interstand tension with high precision.

Another object of the present invention is to provide an interstand tension control method and apparatus for a tandem rolling mill which can roll a workpiece with high precision.

Still another object of the present invention is to provide an interstand tension control method and apparatus for a tandem rolling mill which can roll a workpiece at a high rolling speed.

Yet another object of the present invention is to provide an interstand tension control method and apparatus for a tandem rolling mill which is suitable for rolling of a workpiece into an angle bar, a round bar, a square bar, a wire or the like.

The above and other objects, features and advantages of the present invention will be apparent from the following detailed description taken in conjunction with the accompanying drawing, in which.

Figure 1:
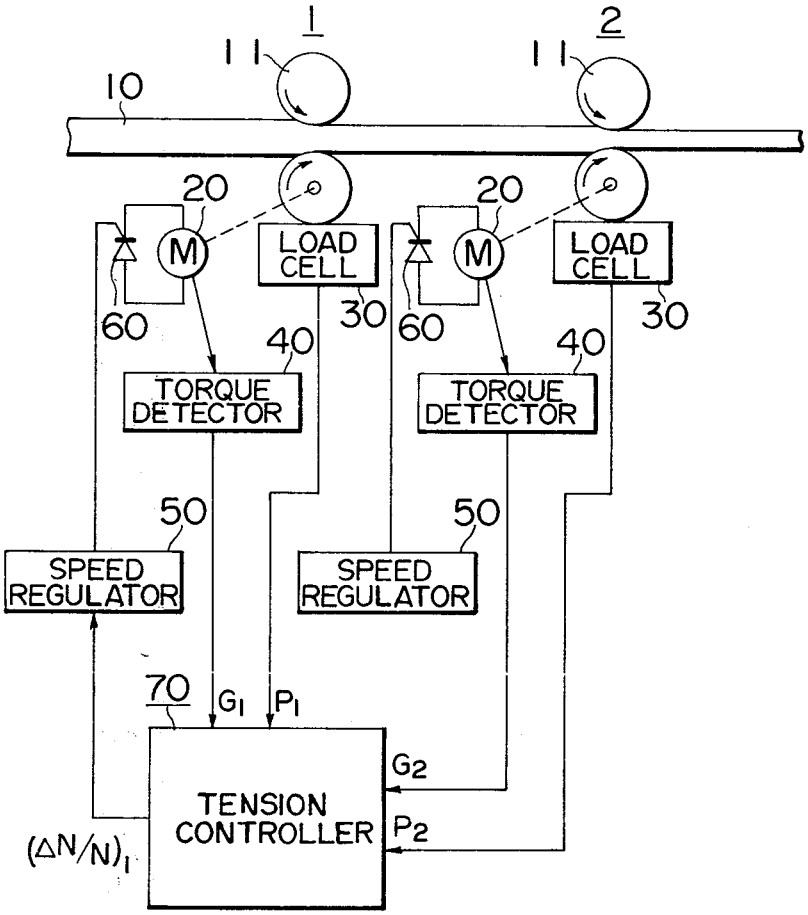
FIG. 1 is a block diagram of a control circuit showing an application of a tension-free control method according to the present invention to a tandem rolling mill consisting of two rolling stands.

The basic principle of the present invention will be first described.

Suppose that a workpiece is being rolled by a first rolling stand and a second rolling stand arranged in tandem in a state in which a tension T is imparted thereto. Then, the following relations hold at the individual rolling stands:

$$\begin{cases} \dfrac{G_1}{P_1} = l_1 - \dfrac{R_1}{P_1} T & (1) \\ \dfrac{G_2}{P_2} = l_2 + \dfrac{R_2}{R_2} T & (2) \end{cases}$$

where G, P, l and R are the rolling torque, rolling force, torque arm and roll radius respectively, and the suffixes 1 and 2 are added to represent those of the first and second rolling stands respectively. The suffix 0 is further added to each of these values to represent the state in which the workpiece is being rolled tension-free. Then, the following equations are obtained from the equations (1) and (2):

$$\begin{cases} \dfrac{G_{10}}{P_{10}} = l_{10} & (3) \\ \dfrac{G_{20}}{P_{20}} = l_{20} & (4) \end{cases}$$

From the equations (1), (2), (3) and (4), the tension T is given by $$T = \frac{\left\{\left(\frac{G_{10}}{P_{10}}\right) - \left(\frac{G_1}{P_1}\right)\right\} - \left\{\left(\frac{G_{20}}{P_{20}}\right) - \left(\frac{G_2}{P_2}\right)\right\} - \left\{(l_{10} - l_1) - (l_{20} - l_2)\right\}}{\left(\frac{R_1}{P_1} + \frac{R_2}{P_2}\right)} \quad (5)$$

In the equation (5), the third term $\{(l_{10}-l_1)-(l_{20}-l_2)\}$ in the numerator represents the time-dependent variation of the torque arm difference in the first and second rolling stands and is negligibly small compared with the difference between the first and second terms of the numerator. Since $G/P=l$ when the workpiece is being rolled tension free as indicated in equations (3) and (4), hereinafter the term generally given by $G/P$ will be called torque arm. Further, the torque arms $(G_1/P_1)$ and $(G_2/P_2)$ can be computed on the basis of the rolling torques $G_1$, $G_2$ and rolling forces $P_1$, $P_2$ actually measured at the first and second rolling stands rolling the workpiece, and the torque arm $(G_{10}/P_{10})$ can be computed on the basis of the rolling torque $G_{10}$ and rolling force $P_{10}$ detected immediately after the workpiece is fed into the nip between the rolls of the first rolling stand but before the workpiece is fed into the nip between the rolls of the second rolling stand.

The suffix B is added to G and P to represent the values of the rolling torque and rolling force detected immediately after the workpiece is fed into the nip between the rolls of the second rolling stand. Then, the ratio $(G_{20}/P_{20})$ is given by $$\begin{aligned} \left(\frac{G_{20}}{P_{20}}\right) &= l_{20} \approx l_{2B} \\ &= \left(\frac{G_{2B}}{P_{2B}}\right) - \left(\frac{R_2}{R_1}\right)\left(\frac{P_{1B}}{P_{2B}}\right)\left\{l_{1B} - \left(\frac{G_{1B}}{P_{1B}}\right)\right\} \\ &\fallingdotseq \left(\frac{G_{2B}}{P_{2B}}\right) - \left(\frac{R_2}{R_1}\right)\left(\frac{P_{1B}}{P_{2B}}\right)\left\{l_{10} - \left(\frac{G_{1B}}{P_{1B}}\right)\right\} \end{aligned} \quad (6)$$

In the equation (6), it is assumed that $l_{20} \approx l_{2B}$ and $l_{10} \approx l_{1B}$. Therefore, the value of the ratio $(G_{20}/P_{20})$ can be computed on the basis of the rolling torque $G_{1B}$ and rolling force $P_{1B}$ actually measured at the first rolling stand and on the basis of the rolling torque $G_{2B}$ and rolling force $P_{2B}$ actuall measured at the second rolling stand immediately after the workpiece is fed into the nip between the rolls of the second rolling stand. Thus, from the equation (5), the tension T imparted to the workpiece between the first and second rolling stands is expressed as $$T = \frac{\left\{\left(\frac{G_{10}}{P_{10}}\right) - \left(\frac{G_1}{P_1}\right)\right\} - \left\{\left(\frac{G_{20}}{P_{20}}\right) - \left(\frac{G_2}{P_2}\right)\right\}}{\left(\frac{R_1}{P_1} + \frac{R_2}{P_2}\right)} \quad (7)$$

and the value of the tension $T$ can be maintained to be constant by controlling in such a manner that the right-hand member of the equation (7) has a constant value.

Preferred embodiments of the present invention will now be described in detail with reference to the drawing in which like reference numerals are used to denote like parts.

FIG. 1 is a block diagram of an interstand tension control apparatus of the present invention which is applied to a tandem rolling mill consisting of two rolling stands so that a workpiece moving between the rolling stands can be rolled in a tension-free state.

Referring to FIG. 1, a workpiece 10 is fed progressively into the nip between the upper and lower rolls 11 of a first and a second rolling stand to be rolled into a predetermined shape. The rolls 11 are driven by a motor 20 provided for each of the first and second rolling stands. The rolling force and rolling torque at each of the first and second rolling stands are detected by a load cell 30 and a torque detector 40 respectively.

The output $G_1$ of the torque detector 40 and the output $P_1$ of the load cell 30 associated with the first rolling stand are applied to a tension controller 70. The output $G_1$ of the torque detector 40 and the output $P_2$ of the load cell 30 associated with the second rolling stand are also applied to the tension controller 70. In response to the application of the signals representative of the rolling forces and torques detected at the pair of the rolling stands disposed in tandem, the tension controller 70 carries out necessary computation on the basis of the equations (7) and (6) and applies a speed change instruction signal $(\Delta N/N)_1$ to a speed regulator 50 associated with the first rolling stand so that the tension imparted to the portion of the workpiece 10 moving between the first and second rolling stands can be reduced to zero.

In response to the application of this speed change instruction signal, the speed regulator 50 controls the firing angle of a thyristor chopper 60 for the motor 20 driving the rolls 11 of the first rolling stand, so that the workpiece 10 can be rolled in a state in which the interstand tension is always zero.

Figure 2:
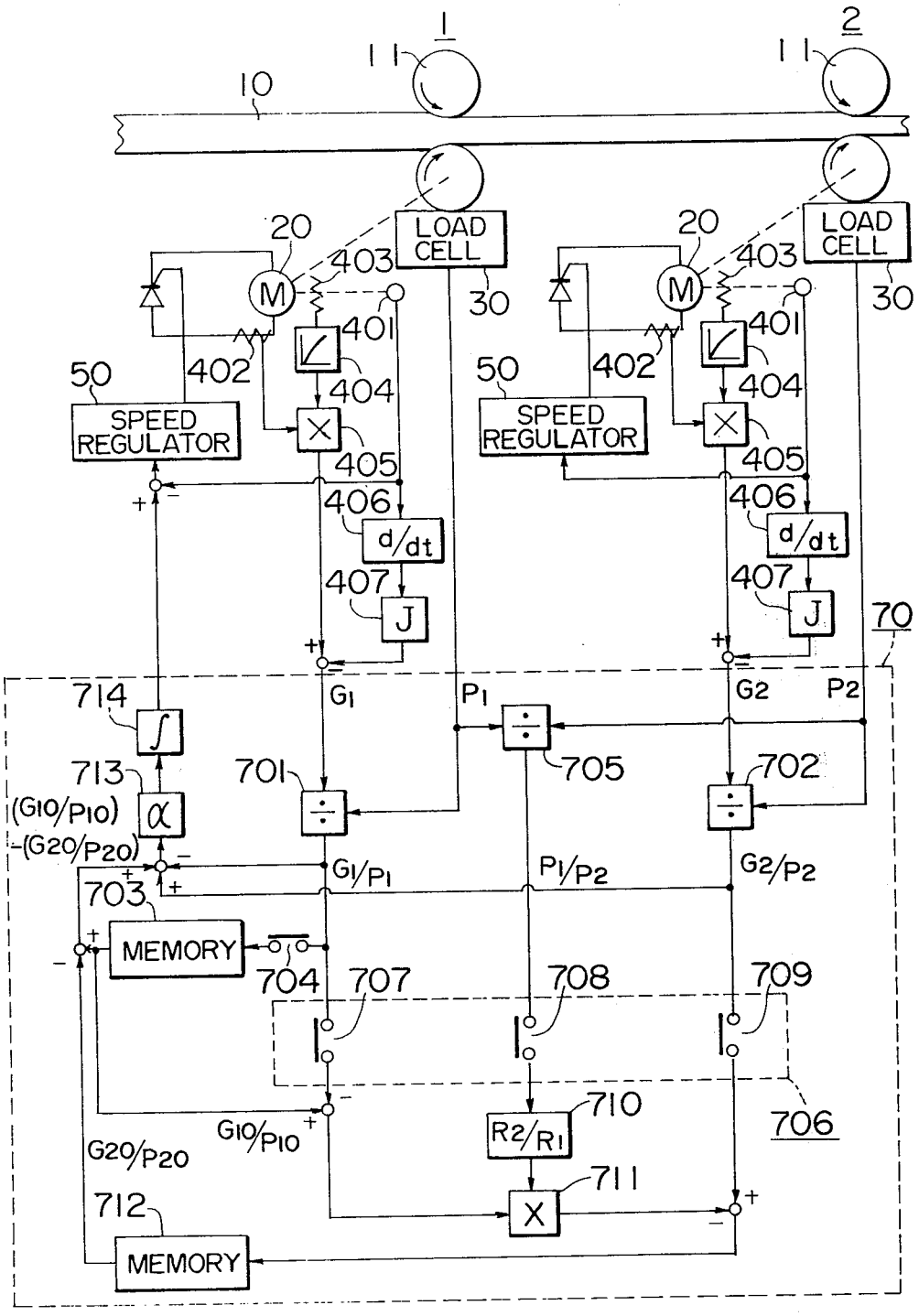
FIG. 2 shows the detailed structure of the control circuit of the present invention shown in the block diagram in FIG. 1.

FIG. 2 shows details of the block diagram shown in FIG. 1. The detailed structure of the interstand tension control apparatus according to the present invention will be described with reference to FIG. 2.

The torque detector 40 provided for each rolling stand in FIG. 1 has a practical structure as described below. A speed detector 401 detects the rotating speed of the motor 20. A current detector 402 detects the current in the main circuit of the motor 20. Another current detector 403 detects the field current of the motor 20. The output of the current detector 403 is applied to a function generator 404 which delivers an output representative of the field strength $\phi$. A multiplier 405 computes the product of the output $\phi$ of the function generator 404 and the output of the current detector 402. A differentiator 406 differentiates the output of the speed detector 401 with respect to time and delivers an output representative of the acceleration. The output of the differentiator 406 is applied to a gain adjuster 407 to be converted into an accelerating torque. The difference between this accelerating torque and the output of the multiplier 405 represents the rolling torque G at each rolling stand. (The suffixes 1 and 2 are added to indicate that $G_1$ and $G_2$ represent the torque values at the respective rolling stands.)

The operation of the tension controller 70 will be described in the sequential order with which the interstand tension is controlled according to the present invention.

In the present description, the term "first rolling stand" is used to designate the rolling stand to which a workpiece is initially directed. The rolling torque $G_{10}$ and rolling force $P_{10}$ at the first rolling stand are detected after the workpiece 10 is fed into the nip between the rolls 11 of the first rolling stand but before it is fed into the nip between the rolls 11 of the second rolling stand, that is, when the workpiece 10 is being rolled in a tension-free state. The detected values of the rolling torque $G_{10}$ and rolling force $P_{10}$ are applied to a divider 701 which computes the ratio $G_{10}/P_{10}$ between $G_{10}$ and $P_{10}$, and the value of this ratio $G_{10}/P_{10}$ (representing the reference torque arm value for the first rolling stand in the tension-free state) is applied to a memory 703 to be stored therein. A one-shot relay 704 is deenergized immediately before the workpiece 10 is fed into the nip between the rolls 11 of the second rolling stand.

As soon as the workpiece 10 is fed into the nip between the rolls 11 of the second rolling stand, contacts 707, 708 and 709 of a one-shot relay 706 are closed momentarily, and the reference torque arm value $G_{20}/P_{20}$ for the second rolling stand in the tensionfree state is computed. More precisely, the rolling torques $G_{1B}$, $G_{2B}$ and rolling forces $P_{1B}$, $P_{2B}$ at the first and second rolling stands are detected immediately after the workpiece 10 is fed into the nip between the rolls 11 of the second rolling stand, and dividers 701, 702 and 705 compute the values of the ratios $G_{1B}/P_{1B}$, $G_{2B}/P_{2B}$ and $P_{1B}/P_{2B}$ respectively on the basis of the detected values. The output $G_{1B}/P_{1B}$ of the divider 701 is applied via the relay contact 707 to be subtracted from the value $G_{10}/P_{10}$ stored previously in the memory 703, and the result $(G_{10}/P_{10}) - (G_{1B}/P_{1B})$ is applied to a multiplier 711.

The output $P_{1B}/P_{2B}$ of the divider 705 is applied via the relay contact 708 to a gain converter 710 which computes the value of the product $(R_2/R_1) \times (P_{1B}/P_{2B})$, and such output is also applied to the multiplier 711.

The output $G_{2B}/P_{2B}$ of the divider 702 represents the torque arm value detected at the second rolling stand immediately after the workpiece 10 is fed into the nip between the rolls 11 of the second rolling stand. This output $G_{2B}/P_{2B}$ of the divider 702 is applied via the relay contact 709 so as to subtract from the same the ouptput $(R_2/R_1)\ (P_{1B}/P_{2B}) \times \{(G_{10}/P_{10}) - (G_{1B}/P_{1B})\}$ of the multiplier 711. The result of subtraction is representative of the reference torque arm value for the second rolling stand, and the value given by $(G_{20}P_{20}) = (G_{2B}/P_{2B}) - (R_2/R_1)\ (P_{1B}/P_{2B}) \times \{(G_{10}/P_{10}) - (G_{1B}/P_{1B})\}$ is applied to a memory 712 to be stored therein.

The workpiece 10 which has been fed into the nip between the rolls 11 of the second rolling stand, is now being rolled by both the first and second rolling stands. The deviation of the torque arm value $(G_1/P_1)$ detected at the first rolling stand from the reference torque arm value $(G_{10}/P_{10})$ for the first rolling stand in the above rolling condition, and the deviation of the torque arm value $(G_2/P_2)$ detected at the second rolling stand from the reference torque arm value $(G_{20}/P_{20})$ for the second rolling stand in the above rolling condition, are obtained on the basis of the output $(G_1/P_1)$ of the divider 701, the output $(G_2/P_2)$ of the divider 702, the output $(G_{10}/P_{10})$ of the memory 703, and the output $(G_{20}/P_{20})$ of the memory 712. Then, the difference between the deviation $\{(G_{10}/P_{10}) - (G_1/P_1)\}$ and the deviation $\{(G_{20}/P_{20}) - (G_2/P_2)\}$ is sought according to the equation (7), and a speed change instruction signal is applied to the speed regulator 50 associated with the first rolling stand so that the difference $\{(G_{10}/P_{10}) - (G_1/P_1)\} - \{(G_{20}/P_{20}) - (G_2/P_2)\}$ can be reduced to zero. A gain converter 713 acts to convert the above difference into the speed change instruction signal, and an integrator 714 is connected to the gain converter 713.

Figure 3:
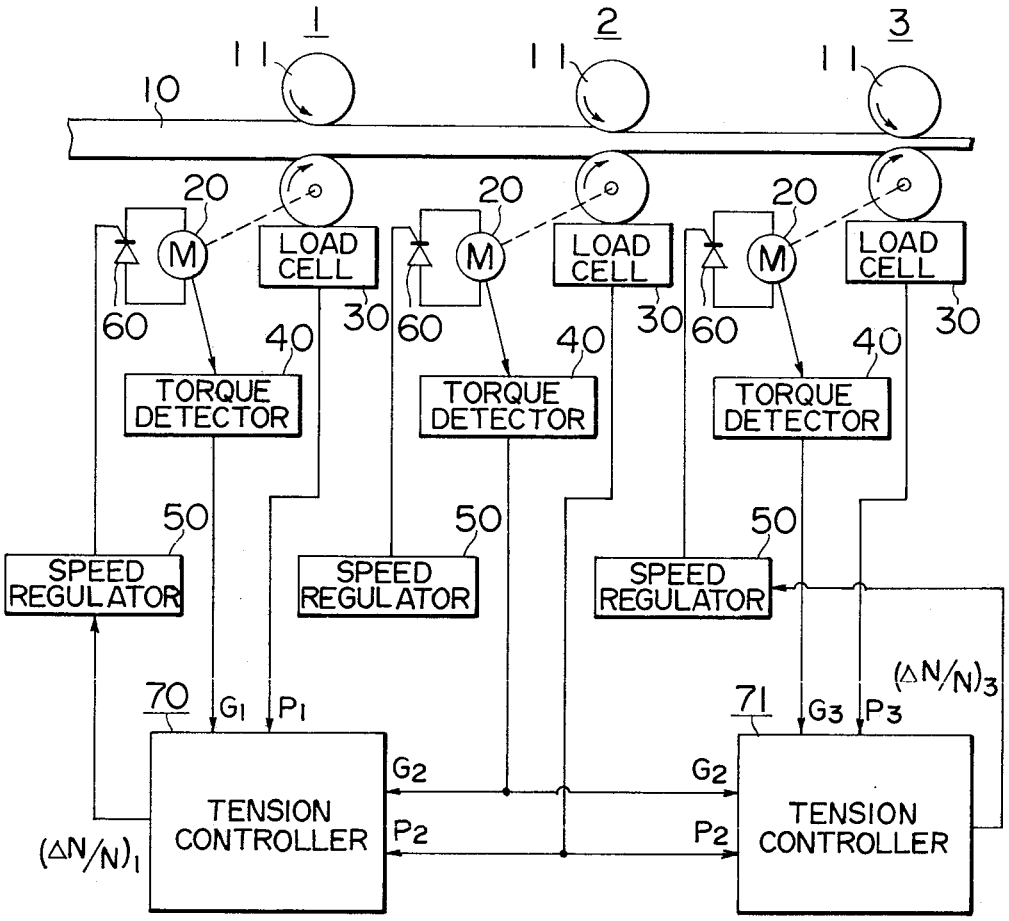
FIG. 3 is a block diagram of a control circuit showing another application of the tension-free control method of the present invention to a tandem rolling mill consisting of three rolling stands.

FIG. 3 shows an application of the present invention to a tandem rolling mill consisting of three rolling stands.

Referring to FIG. 3, the rolling torque $G_2$ and rolling force $P_2$ at the second rolling stand and the rolling torque $G_3$ and rolling force $P_3$ at the third rolling stand are detected, and the signals representative of these detected values are applied to a tension controller 71. In response to the application of these signals, the tension controller 71 applies a speed change instruction signal $(\Delta N/N)_3$ to a speed regulator 50 associated with the third rolling stand for regulating the rolling speed of the third rolling stand so that a workpiece portion moving between the second and third rolling stands can be rolled in a tension-free state.

It will be understood that, according to the present invention, the difference between the torque arm value actually detected during rolling and the reference torque arm value obtained by computation is sought at each of a pair of rolling stands arranged in tandem, and the rolling speed of one of the rolling stands is changed so that the difference at one of the rolling stands is equal to the difference at the other rolling stand. Thus, a workpiece can be rolled in a state in which zero interstand tension is maintained throughout the rolling operation. While the above description has referred to an application of the present invention to a tandem rolling mill consisting of two or three rolling stands, it is readily apparent to those skilled in the art that the present invention is also similarly effectively applicable to a tandem rolling mill consisting of four or more rolling stands.

In the arrangement shown in FIG. 3, the rolling speed of the first rolling stand is changed to maintain zero interstand tension for the workpiece portion moving between the first and second rolling stands as described with reference to FIG. 1, and the rolling speed of the third rolling stand is changed to maintain zero interstand tension for the workpiece portion moving between the second and third rolling stands. According to this method, however, regulation or elimination of the tension imparted to the workpiece portion moving between one pair of the rolling stands may possibly give rise to impartation of a tension to the workpiece portion moving between the other pair of the rolling stands.

Figure 4:
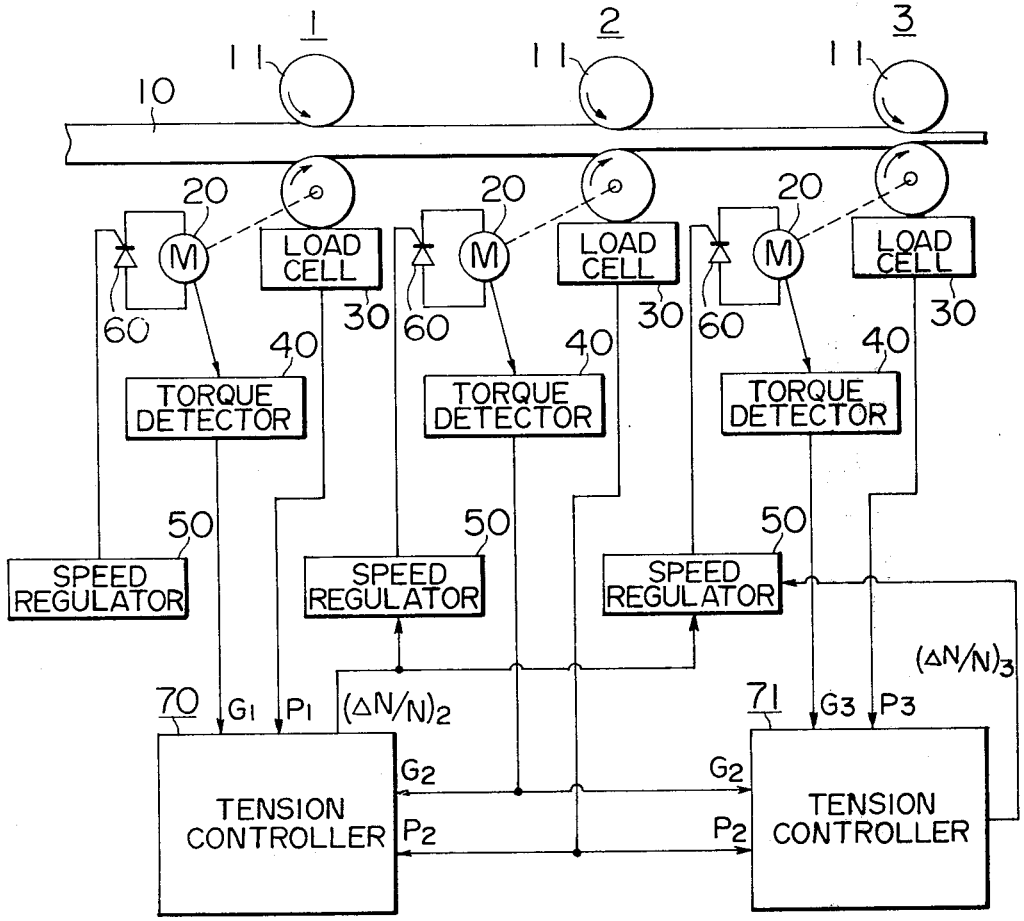
FIG. 4 is a block diagram of another form of the control circuit shown in FIG. 3.

FIG. 4 shows another embodiment of the present invention which eliminates such a possibility and can further improve the quality of control.

Referring to FIG. 4, the rolling torque $G_1$ and rolling force $P_1$ at a first rolling stand and the rolling torque $G_2$ and rolling force $P_2$ at a second rolling stand are detected, and the signals representative of these detected values are applied to a tension controller 70. In response to the application of these signals, the tension controller 70 applies a speed change instruction signal to respective speed regulators 50 associated with the second and third rolling stands for regulating the rolling speed of the second and third rolling stands so that a workpiece portion moving between the second and third rolling stands can be rolled in a tension-free state. The signals representative of the rolling torque $G_3$ and rolling force $P_3$ detected at the third rolling stand are applied to a tension controller 71 together with the signals representative of the rolling torque $G_2$ and rolling force $P_2$ at the second rolling stand. In response to the application of these signals, the tension controller 71 applies a speed change instruction signal to the speed regulator 50 associated with the third rolling stand.

It will thus be seen that, in a tandem rolling mill consisting of at least three rolling stands, all the interstand tensions are preferably controlled in a successive fashion so that regulation of the rolling speed of one rolling stand pair may not result in impartation of a tension to a workpiece portion moving between another rolling stand pair.

In the embodiment shown in FIG. 4, the first rolling stand is selected to be the key rolling stand, and the successive interstand tension control is carried out between the first and second rolling stands and between the second and third rolling stands. However, the second rolling stand may be the key rolling stand, and the successive interstand tension control may be carried out between the first and second rolling stands and between the second and third rolling stands to attain the same effect as that above described. In a tandem rolling mill consisting of four or more rolling stands, the successive interstand tension control may be carried out between the adjacent rolling stand pairs to attain the same effect as that above described.

The above embodiments have been described with reference to the case in which the interstand tension imparted to a workpiece is controlled to be maintained at zero for rolling the workpiece in a tension-free state.

A method and apparatus will now be described in which a controlled tension is imparted to a workpiece portion moving between a pair of rolling stands so as to roll the workpiece in a state in which a constant tension is imparted thereto.

Suppose that a workpiece is rolled by a tandem rolling mill consisting of two rolling stands while being imparted with a predetermined tension $\overline{T}$, and the tension is varied by $\Delta T$ due to disturbance. Then, the following equation is obtained from the equation (7):

$$\left(\frac{R_1}{P_1} + \frac{R_2}{P_2}\right)\Delta T = \left\{\left(\frac{G_{10}}{P_{10}}\right) - \left(\frac{G_1}{P_1}\right)\right\} - \left\{\left(\frac{G_{20}}{P_{20}}\right) - \left(\frac{G_2}{P_2}\right)\right\} - \left(\frac{R_1}{P_1} + \frac{R_2}{P_2}\right)\overline{T} \quad (8)$$

It will therefore be seen that the workpiece portion moving between the first and second rolling stands can be rolled while being imparted with the predetermined constant tension $\overline{T}$ when the rolling speed of the first or second rolling stand is controlled in such a manner that the variation $\Delta T$ in the tension imparted to the workpiece due to the disturbance is reduced to zero always.

Figure 5:
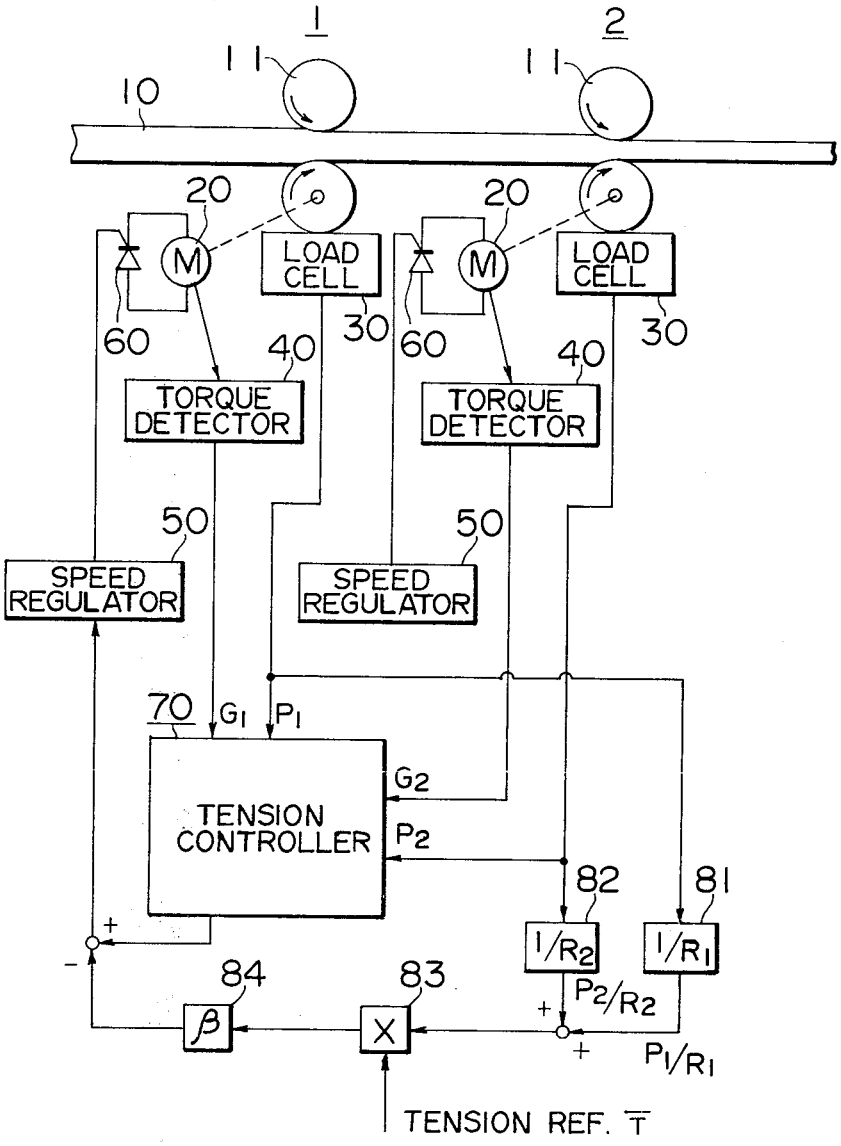
FIG. 5 is a block diagram of a modification of the control circuit of FIG. 1, showing an application of a constant tension control method according to the present invention to a tandem rolling mill consisting of two rolling stands.

FIG. 5 is a block diagram of an interstand tension control apparatus according to the present invention in which the method of rolling a workpiece while imparting a predetermined tension $\overline{T}$ thereto is applied to a tandem rolling mill consisting of two rolling stands. In FIG. 5, torque detectors 40, load cells 30, speed regulators 50 and a tension controller 70 are the same as those shown in FIG. 1, and any detailed description of their construction is unnecessary.

Referring to FIG. 5, a gain converter 81 is provided for multiplying the output $P_1$ of the load cell 30 associated with the first rolling stand by the reciprocal of the radius $R_1$ of the rolls 11 of the first rolling stand. Another gain converter 82 is provided for multiplying the output $P_2$ of the load cell 30 associated with the second rolling stand by the reciprocal of the radius $R_2$ of the rolls 11 of the second rolling stand. The sum $(P_1/R_1 + P_2/R_2)$ of the outputs of the gain converters 81 and 82 is multiplied by the predetermined tension setting $\overline{T}$ in a multiplier 83, and the output $\overline{T}(P_1/R_1 + P_2/R_2)$ of the multiplier 83 is applied to another gain converter 84. This gain converter 84 converts the output of the multiplier 83 into a corresponding speed change instruction signal which is representative of the value $\beta\overline{T}(P_1/R_1 + P_2/R_2)$ where $\beta$ is the gain of the gain converter 84. The difference between this speed instruction signal representative of the value $\beta\overline{T}(P_1/R_1 + P_2/R_2)$ and the output of the tension controller 70 is applied to the speed regulator 50 associated with the first rolling stand. Therefore, the rotating speed of the motor 20 which drives the rolls 11 of the first rolling stand is controlled so that the tension imparted to the workpiece between the first and second rolling stands is equal to the predetermined tension setting $\overline{T}$.

It will thus be understood that, according to this method of the present invention, a workpiece portion moving between the rolling stands can be rolled in a state in which a predetermined tension (including zero tension) is imparted thereto.

The present invention is also applicable to a tandem rolling mill of the kind in which an edger mill is disposed between a pair of adjacent rolling stands for rolling the side faces of a workpiece or controlling the transverse width of a workpiece being rolled. In such an application, the manner of interstand tension control described with reference to FIGS. 1 to 5 may be applied for controlling the interstand tension, and the rolling speed of the edger mill may be controlled so that the rolling torque at the edger mill disposed between these rolling stands may be maintained constant.

Preferred embodiments of the present invention have been described with reference to a tandem rolling mill adapted for rolling a workpiece into a strip. However, the present invention is most suitable for an application to a tandem rolling mill adapted for rolling a workpiece into an angle bar, a round bar, a square bar, a wire or the like in which the tension appearing in the rolling operation exerts a great influence upon the quality of products and the tension imparted to the workpiece cannot be directly measured by contact with the workpiece.

In some forms of the present invention described hereinbefore, the apparatus has been arranged in such a manner that the rolling speed of the rolling stands is controlled in response to the impartation of a tension to the workpiece portion between the rolling stands so as to reduce the tension to zero. However, the screwdown ratio of one of or all of the rolling stands may be controlled in response to the impartation of a tension to the workpiece portion between the rolling stands so as to reduce the tension to zero.

The advantages of the present invention will be summarized.

In the prior art as above-mentioned, the rolling speed of any stand is controlled on the basis of a reference torque arm on that stand, which is measured as an average of values of torque arms exerted during the moment just after the leading end of a workpiece passes through that stand to the moment just before the leading end of the workpiece reaches the next stand, so that the torque arm on that stand during the rolling operation is equal to the reference torque arm. On the other hand, in the present invention, the rolling speed of any stand is controlled on the basis of a reference torque arm, which is calculated from a torque arm on that stand at a moment when the leading end of a workpiece has just passed through that stand, the actual torque arm of a stand adjacent to that stand and the reference torque arm on the adjacent stand, so that the difference between the actual torque arm and the reference torque arm on that stand is equal to the difference between those values on the adjacent stand. Therefore, it is possible to determine the reference torque arm on any stand as soon as the leading end of a workpiece has passed through that stand and to control the rolling speed of that stand on the basis of the value of reference torque arm thus determined, whereby the detected values of torque arms are substantially free from errors due to impact drop at the moment when the leading end of a workpiece comes into the nip between the rolls of the respective stand and the interstand tension can be controlled with high precision regardless of the presence of skid marks, thermal rundown and abrupt variations in the thickness of the workpiece being rolled.

Further, according to the present invention, the interstand tension control for the workpiece between, for example, the first and second rolling stands has been completed before the workpiece moving past one rolling stand toward the succeeding rolling stand is fed into the nip between the rolls of the succeeding rolling stand. Therefore, the workpiece can be rolled satisfactorily at a high speed not only at the normal running, but also at acceleration and deceleration.

What is claimed is:

1. In a tandem rolling mill consisting of at least a first rolling stand and a second rolling stand, an interstand tension control method for controlling the interstand tension imparted to a workpiece being rolled by said first and second rolling stands, comprising the first step of computing the reference torque arm for said first rolling stand and storing the same in a memory after the workpiece is fed into the nip between the rolls of said first rolling stand but before the workpiece is fed into the nip between the rolls of said second rolling stand, the second step of detecting the respective torque arms at said first and second rolling stands immediately after the workpiece is fed into the nip between the rolls of said second rolling stand and computing the reference torque arm for said second rolling stand on the basis of the torque arm values detected at said first and second rolling stands and the stored reference torque arm value for said first rolling stand for storing the reference torque arm value for said second rolling stand in a memory, and the third step of detecting the respective torque arms at said first and second rolling stands while the workpiece is being rolled by both said first and second rolling stands and computing the difference between the deviation of the detected torque arm value at said first rolling stand from the stored reference torque arm value for said first rolling stand and the deviation of the detected torque arm value at said second rolling stand from the stored reference torque arm value for said second rolling stand, and controlling the interstand tension imparted to the workpiece moving between said first and second rolling stands to be constant in response to the value of the difference thus computed.

2. In a tandem rolling mill consisting of at least a first rolling stand and a second rolling stand, an interstand tension control method for controlling the interstand tension imparted to a workpiece being rolled by said first and second rolling stands, comprising the first step of detecting the rolling torque and rolling force at said first rolling stand after the workpiece is fed into the nip between the rolls of said first rolling stand but before the workpiece is fed into the nip between the rolls of said second rolling stand and computing the rolling torque to rolling force ratio representative of the reference torque arm for said first rolling stand for storing such reference torque arm value in a memory, the second step of detecting the respective rolling torques and rolling forces at said first and second rolling stands immediately after the workpiece is fed into the nip between the rolls of said second rolling stand and computing the reference torque arm for said second rolling stand on the basis of these detected values and the stored reference torque arm value for said first rolling stand for storing the reference torque arm value for said second rolling stand in a memory, and the third step of detecting the respective rolling torques and rolling forces at said first and second rolling stands while the workpiece is being rolled by both said first and second rolling stands for computing the respective rolling torque to rolling force ratios at said first and second rolling stands to obtain the respective torque arms at said first and second rolling stands and then computing the difference between the deviation of the detected torque arm value at said first rolling stand from the stored reference torque arm value for said first rolling stand and the derivation of the detected torque arm valves at said second rolling stand from the stored reference to torque arm value for said second rolling stand, and controlling the interstand tension imparted to the workpiece portion moving between said first and second rolling stands to be constant in response to the value of the difference thus computed.

3. An interstand tension control method as claimed in claim 2, wherein said third step comprises controlling the rolling speed of said first rolling stand relative to that of said second rolling stand so that said difference is equal to the product of the roll radius to detected rolling force ratio at each said rolling stand and the desired value of the interstand tension to be imparted to the workpiece.

4. An interstand tension control method as claimed in claim 2, wherein the interstand tension imparted to the workpiece moving between said first and second rolling stands is reduced to zero by controlling the rolling speed of said first rolling stand relative to that of said second rolling stand in such a manner that said difference is reduced to zero, that is, the torque arm deviation at said first rolling stand is equal to that at said second rolling stand.

5. An interstand tension control method as claimed in claim 4, wherein the rolling speed of said first rolling stand is controlled so that said difference can be reduced to zero, That is, the torque arm deviation at said first rolling stand is equal to that at said second rolling stand.

6. An interstand tension control method as claimed in claim 4, wherein the rolling speed of said second rolling stand is controlled so that said difference can be reduced to zero, that is, the torque arm deviation at said first rolling stand is equal to that at said second rolling stand.

7. In a tandem rolling mill consisting of at least a first rolling stand, a second rolling stand and a third rolling stand, an interstand tension control method for controlling the interstand tension imparted to a workpiece being rolled by said first, second and third rolling stands, comprising the first step of detecting the rolling torque and rolling force at said first rolling stand after the workpiece is fed into the nip between the rolls of said first rolling stand but before the workpiece is fed into the nip between the rolls of said second rolling stand and computing the rolling torque to rolling force ratio representative of the reference torque arm for said first rolling stand for storing such reference torque arm value in a memory, the second step of detecting the respective rolling torques and rolling forces at said first and second rolling stands immediately after the workpiece is fed into the nip between the rolls of said second rolling stand and computing the reference torque arm for said second rolling stand on the basis of these detected values and the stored reference torque arm value for said first rolling stand for storing the reference torque arm value for said second rolling stand in a memory, and the third step of detecting the respective rolling torques and rolling forces at said first and second rolling stands while the workpiece is being rolling by both said first and second rolling stands for computing the respective rolling torque to rolling force ratios at said first and second rolling stands to obtain the respective torque arms at said first and second rolling stands and then computing the difference between the deviation of the detected torque arm value at said second rolling stand from the stored reference torque arm value for said first rolling stand and the deviation of the detected torque arm value at said second rolling stand from the stored reference torque arm value for said second rolling stand so as to reduce said difference to zero by controlling the rolling speed of any one of said first and second rolling stands, the fourth step of detecting the respective rolling torques and rolling forces at said second and third rolling stands immediately after the workpiece is fed into the nip between the rolls of said third rolling stand and computing the reference torque arm for said third rolling stand on the basis of these detected values and the stored reference torque arm value for said second rolling stand for storing the reference torque arm value for said third rolling stand in a memory, and the fifth step of detecting the respective rolling torques and rolling forces at said first, second and third rolling stands while the workpiece is being rolled by at least said first, second and third rolling stands for computing the respective rolling torque to rolling force ratios at said first, second and third rolling stands to obtain the respective torque arms at said first, second and third rolling stands and controlling the rolling speed of said second rolling stand so as to reduce to zero the difference between the deviation of the detected torque arm value at said first rolling stand from the stored reference torque arm value for said first rolling stand and the deviation of the detected torque arm value at said second rolling stand from the stored reference torque arm value for said second rolling stand while, at the same time, controlling the rolling speed of said third rolling stand so as to reduce to zero the difference between the deviation of the detected torque arm value at said second rolling stand from the stored reference torque arm value for said second rolling stand and the deviation of the detected torque arm value at said third rolling stand from the stored reference torque arm value for said third rolling stand.

8. An interstand tension control method as claimed in claim 7, wherein said fifth step comprises controlling the rolling speed of said second and third rolling stands so that the difference between said torque arm deviation at said first rolling stand and that at said second rolling stand can be reduced to zero, and controlling the rolling speed of said third rolling stand so that the difference between said torque arm deviation at said second rolling stand and that at said third rolling stand can be reduced to zero.

9. An interstand tension control method as claimed in claim 7, wherein said fifth step comprises controlling the rolling speed of said first and third rolling stands so that the difference between said torque arm deviation at said first rolling stand and that at said second rolling stand can be reduced to zero, and controlling the rolling speed of said third rolling stand so that the difference between said torque arm deviation at said second rolling stand and that at said third rolling stand can be reduced to zero.

10. In a tandem rolling mill consisting of at least a first rolling stand and a second rolling stand, an interstand tension control apparatus for controlling the interstand tension imparted to a workpiece being rolled by said first and second rolling stands, comprising first rolling force detecting means for detecting the rolling force at said first rolling stand, first rolling torque detecting means for detecting the rolling torque at said first rolling stand, first computing means for computing the torque arm at said first rolling stand determined by the ratio of the output of said first rolling torque detecting means to the output of said first rolling force detecting means, first memory means for storing the output of said first computing means appearing immediately after the workpiece is fed into the nip between the rolls of said first rolling stand, said output of said first computing means being representative of the reference torque arm value for said first rolling stand, second rolling force detecting means for detecting the rolling force at said second rolling stand, second rolling torque detecting means for detecting the rolling torque at said second rolling stand, second computing means for computing the torque arm at said second rolling stand determined by the ratio of the output of said second rolling torque detecting means to the output of said second rolling force detecting means, second memory means for storing the output of said second computing means appearing immediately after the workpiece is fed into the nip between the rolls of said second rolling stand, third computing means for computing the reference torque arm value for said second rolling stand on the basis of the output of said first memory means, the output of said first computing means appearing immediately after the workpiece is fed into the nip between the rolls of said second rolling stand and the output of said second memory means, fourth computing means for computing the difference between the value representing the difference between the output of said first memory means and the output of said third computing means and the value representing the difference between the output of said first computing means and the output of said second computing means while the workpiece is being rolled by said first and second rolling stands, and control means for controlling the relative rolling speed between said first and second rolling stands in response to the difference computed by said fourth computing means.

11. An interstand tension control apparatus as claimed in claim 10, wherein said control means controls the relative rolling speed of said first and second rolling stands so that the difference computed by said fourth computing means is equal to the product of $(R_1/P_1 + R_2/P_2)$ and $\overline{T}$ in which $R_1/P_1$ is the product of the roll radius $R_1$ of said first rolling stand and the reciprocal of the output $P_1$ of said first rolling force detecting means, $R_2/P_2$ is the product of the roll radius $R_2$ of said second rolling stand and the reciprocal of the output $P_2$ of said second rolling force detecting means, and $\overline{T}$ represents a predetermined interstand tension to be imparted to the workpiece moving between said first and second rolling stands.

12. In a tandem rolling mill consisting of at least a first rolling stand, a second rolling stand and a third rolling stand, an interstand tension control apparatus for controlling the interstand tension imparted to a workpiece being rolled by said first, second and third rolling stands, comprising first rolling force detecting means for detecting the rolling force at said first rolling stand, first rolling torque detecting means for detecting the rolling torque at said first rolling stand, first computing means for computing the torque arm at said first rolling stand determined by the ratio of the output of said first rolling torque detecting means to the output of said first rolling force detecting means, first memory means for storing the output of said first computing means appearing immediately after the workpiece is fed into the nip between the rolls of said first rolling stand, said output of said first computing means being representative of the reference torque arm value for said first rolling stand, second rolling force detecting means for detecting the rolling force at said second rolling stand, second rolling torque detecting means for detecting the rolling torque at said second rolling stand, second computing means for computing the torque arm at said second rolling stand determined by the ratio of the output of said second rolling torque detecting means to the output of said second rolling force detecting means, second memory means for storing the output of said second computing means appearing immediately after the workpiece is fed into the nip between the rolls of said second rolling stand, third rolling force detecting means for detecting the rolling force at said third rolling stand, third rolling torque detecting means for detecting the rolling torque at said third rolling stand, third computing means for computing the torque arm at said third rolling stand determined by the ratio of the output of said third rolling torque detecting means to the output of said third rolling force detecting means, third memory means for storing the output of said third computing means appearing immediately after the workpiece is fed into the nip between the rolls of said third rolling stand, fourth computing means for computing the reference torque arm value for second rolling stand on the basis of the output of said first memory means, the output of said first computing means appearing immediately after the workpiece is fed into the nip between the rolls of said second rolling stand and the output of said second memory means, fifth computing means for computing the difference between the value representing the difference between the output of said first memory means and the output of said fourth computing means and the value representing the difference between the output of said first computing means and the output of said second computing means while the workpiece is being rolled by said first and second rolling stands, first control means for controlling the relative rolling speed between said first and second rolling stands in response to the difference computed by said fifth computing means, sixth computing means for computing the reference torque arm value for said third rolling stand on the basis of the output of said second memory means, the output of said second computing means appearing immediately after the workpiece is fed into the nip between the rolls of said third rolling stand and the output of said third memory means, seventh computing means for computing the difference between the value representing the difference between the output of said forth computing means and the output of said sixth computing means and the value representing the difference between the output of said second computing means and the output of said third computing means while the workpiece is being rolled by said first, second and third rolling stands, and second control means for controlling the relative rolling speed between said second and third rolling stands in response to the difference computed by said seventh computing means.

13. An interstand tension control apparatus as claimed in claim 12, wherein said first control means controls the relative rolling speed of said first and second rolling stands so that the difference computed by said fifth computing means is equal to the product of $(R_1/P_1 + R_2/P_2)$ and $\overline{T}$ in which $R_1/P_1$ is the product of the roll radius $R_1$ of said first rolling stand and the reciprocal of the output $P_1$ of said first rolling force detecting means, $R_2/P_2$ is the product of the roll radius $R_2$ of said second rolling stand and the reciprocal of the output of said second rolling force detecting means, and $\overline{T}$ is a predetermined interstand tension to be imparted to the workpiece portion moving between said first and second rolling stands, and said second control means controls the relative rolling speed of said second and third rolling stands so that the difference computed by said seventh computing means is equal to the product of $(R_2/P_2 + R_3/P_3)$ and $\overline{T}$ in which $R_2/P_2$ is the product of the roll radius $R_2$ of said second rolling stand and the reciprocal of the output $P_2$ of said second rolling force detecting means, $R_3/P_3$ is the product of the roll radius $R_3$ of said third rolling stand and the reciprocal of the output $P_3$ of said third rolling force detecting means and $\overline{T}$ is the predetermined interstand tension to be imparted to the workpiece portion moving between said second and third rolling stands.

14. An interstand tension control apparatus as claimed in claim 12, wherein the relative rolling speed between said second and third rolling stands is controlled in response to the difference computed by said fifth computing means, and the rolling speed of said third rolling stand is controlled in response to the difference computed by said seventh computing means.

15. An interstand tension control apparatus as claimed in claim 12, wherein the rolling speed of said first rolling stand relative to that of said third rolling stand is controlled in response to the difference computed by said fifth computing means, and the rolling speed of said third rolling stand is controlled in response to the difference computed by said seventh computing means.

* * * * *